US007072604B2

(12) United States Patent
Miura et al.

(10) Patent No.: US 7,072,604 B2
(45) Date of Patent: Jul. 4, 2006

(54) ELECTRO-CONDUCTIVE ROLL AND IMAGE-FORMING APPARATUS USING THE SAME

(75) Inventors: Hiroyuki Miura, Minamiashigara (JP); Hiroshi Takayama, Minamiashigara (JP); Minoru Rokutan, Minamiashigara (JP); Ryusei Kouda, Minamiashigara (JP); Takahiko Hattori, Suzuka (JP); Ryuji Watanabe, Suzuka (JP)

(73) Assignee: Fuji Xerox Co., Ltd., Tokyo (JP)

( * ) Notice: Subject to any disclaimer, the term of this patent is extended or adjusted under 35 U.S.C. 154(b) by 169 days.

(21) Appl. No.: 10/803,892

(22) Filed: Mar. 19, 2004

(65) Prior Publication Data

US 2004/0247340 A1 Dec. 9, 2004

(30) Foreign Application Priority Data

Mar. 19, 2003 (JP) ..... 2003-075780
Nov. 14, 2003 (JP) ..... 2003-385996

(51) Int. Cl.
*G03G 15/02* (2006.01)
*G03G 15/16* (2006.01)
*G03G 21/00* (2006.01)

(52) U.S. Cl. ..... 399/176; 361/221; 399/313; 399/357

(58) Field of Classification Search ..... 399/174, 399/168, 352, 357, 176, 313; 361/221, 216; 430/902; 492/28
See application file for complete search history.

(56) References Cited

U.S. PATENT DOCUMENTS

| | | | | |
|---|---|---|---|---|
| 5,659,854 | A * | 8/1997 | Masuda et al. | 399/176 |
| 5,982,606 | A * | 11/1999 | Masuda et al. | 361/225 |
| 6,052,549 | A * | 4/2000 | Shimura et al. | 399/176 |
| 2002/0081130 | A1 * | 6/2002 | Endo et al. | 399/349 |
| 2002/0102115 | A1 * | 8/2002 | Sato et al. | 399/313 |
| 2003/0095812 | A1 * | 5/2003 | Nagamori et al. | 399/176 |

FOREIGN PATENT DOCUMENTS

| | | | |
|---|---|---|---|
| JP | A 58-194061 | | 11/1983 |
| JP | 61-091682 | A * | 5/1986 |
| JP | A 1-204081 | | 8/1989 |
| JP | A 2-301777 | | 12/1990 |
| JP | A 2-301779 | | 12/1990 |
| JP | A 7-49605 | | 2/1995 |
| JP | 09-325575 | A * | 12/1997 |

* cited by examiner

*Primary Examiner*—Sophia S. Chen
(74) *Attorney, Agent, or Firm*—Oliff & Berridge, PLC

(57) ABSTRACT

An electro-conductive roll is provided that makes contact with a body to be charged in a state in which a voltage is applied thereto, and charges the body to be charged, a surface of the electro-conductive roll satisfying the following conditions (a) and (b):
(a) the surface of the electro-conductive roll has a 10-point average roughness of 5 μm or less; and
(b) the surface of the electro-conductive roll has a dynamic ultra-microhardness in the range of 0.04 to 0.5.

18 Claims, 2 Drawing Sheets

ELECTRO-CONDUCTIVE ROLL AND IMAGE-FORMING APPARATUS USING THE SAME

CROSS-REFERENCE TO RELATED APPLICATIONS

This application claims priority under 35 USC 119 from Japanese Patent Application Nos. 2003-75780 and 2003-385996, the disclosures of which are incorporated by reference herein.

BACKGROUND OF THE INVENTION

1. Field of the Invention

The present invention relates to an electro-conductive roll such as a charging roll, a transfer roll, or a cleaning roll used in an electrophotographic process or an electrostatic recording process in an image forming apparatus, such as an electrophotographic copying machine or a printer; and an image forming apparatus using the electro-conductive roll.

2. Description of the Related Art

Recently in image forming apparatuses using electrophotographic systems, charging rolls have been widely used as members for uniformly charging the surface of a body to be charged, such as a photoreceptor. The charging roll, which has voltage applied thereto, comes in contact with the photoreceptor, and discharges electricity at a micro gap between the charging roll and the photoreceptor, thereby causing the surface of the photosensitive material to be charged. The resistance and shape of the above-described charging roll are strictly controlled so as to allow uniform charging of the photoreceptor.

In image forming apparatuses for electrophotography using charging rolls, foreign substances such as residual transfer toner, carrier, and paper dust, which adhere to the photoreceptor surface, come into a nip portion between the charging roll and the photoreceptor. Therefore, the foreign substances adhere to the surface of the charging roll and contaminate the charging roll. If foreign substances adhere to the surface of the charging roll, the portion of the charging roll with the foreign substances adhering thereto has a high resistance, thereby causing poor charging of the photoreceptor or abnormal discharging at the portion of the charging roll having the foreign substances. As a result, image defects such as white spots or color spots form in an image that has been developed and transferred. A charging roll that is continuously contaminated with foreign substances adhering thereto over a long period of time causes uneven resistance of the roll as a whole. Accordingly, irregular charging of the photoreceptor is apt to occur, and image defects such as unevenness of density, or white spots or color spots over the entire image are generated in the formed image.

Particularly, there has been an increasing demand for both enhancement of image quality and longer operating life in recent electrophotographic image forming apparatuses, and uneven charging that could not be detected by conventional methods causes image defects. Further, in cases in which a charging system employing only a direct current voltage application for the purpose of reducing the costs of an image forming apparatus, image defects caused by adhesion of foreign substances becomes even more conspicuous as compared with a conventional apparatus in which voltage is applied by superimposing an alternating current on a direct current to contemplate uniform charging. Moreover, brushes or rolls have been recently employed as a cleaning member of a photoreceptor in place of a blade, because of long-term use of the photoreceptor. However, when compared to using a blade, such brushes or rolls cause a larger amount of foreign substances, including toner, to penetrate into the charging roll.

In order to prevent the occurrence of image defects caused by the adhesion of foreign substances, there has been conventionally attempted: a method that reduces adhesion of foreign substances onto a charging roll; or a method of mounting a member for removing attached foreign substances. As the method that reduces adhesion of foreign substances to a charging roll, for example, an attempt has been made in which a surface layer is formed from high-polymer material having a dense molecular structure and having excellent releasing properties, which material is typified by so-called resin, thereby reducing adhesion of foreign substances to the surface of an elastic roll (charging roll) having a high adhesiveness (see Japanese Patent Application Laid-Open (JP-A) Nos. 58-194061 and 1-204081).

Further, as the method of mounting a member for removing an adhered foreign substances, an attempt has been made in which a roll or a pad (see JP-A No. 2-301777), a web (see JP-A No. 2-301779), or the like is made to abut against a charging roll, or a cleaning member is provided in the vicinity of a charging roll (see JP-A No. 58-194061), thereby removing foreign substances adhering to the surface of the charging roll.

Nonetheless, in the method in which the above-mentioned dense polymer material is used for a surface layer, such polymer material is generally hard, and therefore, there are cases in which poor charging may occur due to the adhesion of a small amount of foreign substances, or wear of the photoreceptor may be accelerated.

Further, in the method of mounting a member for removing adhered foreign substances as well, it was found that residual toner on the charging member surface cannot be sufficiently removed and foreign substances tend to gradually accumulate.

An attempt has also been made in which, based on the surface average roughness and film thickness of each of an elastic layer and a surface layer, adhesion of toner to the surface of a charging roll is reduced (JP-A No. 7-49605).

Additionally, the adhesion of foreign substances is a large problem not only for a charging roll, but also for members that are disposed around a photoreceptor in contact with the photoreceptor (for example, a transfer roll, a cleaning roll, and the like) since the durability of the members is deteriorated. Rolls that can fundamentally prevent or reduce adhesion of foreign substances or that do not cause deterioration of performance even if foreign substances adhere to the roll, have yet to be developed.

SUMMARY OF THE INVENTION

The present invention has been made in view of the above circumstances, and provides an electro-conductive roll and image-forming apparatus using the same.

That is, an object of the present invention is to provide an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c): (c) (Rz of a surface of the electro-conductive elastic layer)×0.5≦thickness of the electro-conductive surface layer≦(Rz of a surface of the elastic layer)×2.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; (b) the surface of the electro-conductive roll has a dynamic ultra-microhardness in the range of 0.04 to 0.5; and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c): (c) (Rz of a surface of the electro-conductive elastic layer)×0.5≦thickness of the electro-conductive surface layer≦(Rz of a surface of the elastic layer)×2; the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent; wherein the electro-conductive roll is a charging roll.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll is a transfer roll.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; (b) the surface of the electro-conductive roll has a dynamic ultra-microhardness in the range of 0.04 to 0.5; and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c): (c) (Rz of a surface of the electro-conductive elastic layer)×0.5≦thickness of the electro-conductive surface layer≦(Rz of a surface of the elastic layer)×2; the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent; wherein the electro-conductive roll is a transfer roll.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll is a cleaning roll.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; (b) the surface of the electro-conductive roll has a dynamic ultra-microhardness in the range of 0.04 to 0.5; and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c): (c) (Rz of a surface of the electro-conductive elastic layer)×0.5≦thickness of the electro-conductive surface layer≦(Rz of a surface of the elastic layer)×2; the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent; wherein the electro-conductive roll is a cleaning roll.

The present invention also provides an electro-conductive roll that makes contact with a body to be charged in a state in which a voltage is applied to the roll, and charges the body to be charged, wherein a surface of the electro-conductive roll satisfies the following conditions (a) and (b): (a) the surface of the electro-conductive roll has a 10-point average roughness of 5 μm or less; and (b) the surface of the electro-conductive roll has a dynamic ultra-microhardness in the range of 0.04 to 0.5; and wherein the electroconductive roll includes, on an electro-conductive substrate, two or more electro-conductive layers comprised of at least an electro-conductive elastic layer and an electro-conductive surface layer, and the electro-conductive elastic layer and the electro-conductive surface layer satisfy the following conditions (d) and (e): (d) a surface of the electro-conductive elastic layer has an Rz of 5 μm or less; and (e) the electro-conductive surface layer has a film thickness of 3 μm to 15 μm.

The present invention also provides an image-forming apparatus comprising: a photoreceptor; a charging device that charges the photoreceptor; an exposure device that exposes the charged photoreceptor and forms an electrostatic latent image; a developing device that develops the electrostatic latent image with a toner; and a transfer device that transfers a toner image to a receiving medium; wherein the charging device, in a state where voltage is applied thereto, comes into contact with the photoreceptor, and comprises an electro-conductive roll that charges the photoreceptor, wherein a surface of the electro-conductive roll satisfies the following conditions (a) and (b): (a) the surface of the electro-conductive roll has a 10-point average roughness (Rz) of 5 μm or less; and (b) the surface of the electro-conductive roll has a dynamic ultra-microhardness in the range of 0.04 to 0.5; and wherein the electro-conductive roll includes, on an electro-conductive substrate, two or more electro-conductive layers comprised of at least an electro-conductive elastic layer and an electro-conductive surface layer, and the electro-conductive elastic layer and the electro-conductive surface layer satisfy the following conditions (d) and (e): (d) a surface of the electro-conductive elastic layer has an Rz of 5 μm or less; and (e) the electro-conductive surface layer has a film thickness of 3 μm to 15 μm.

DETAILED DESCRIPTION OF THE INVENTION

The present invention will be hereinafter described in detail.

An electro-conductive roll of the present invention is an electro-conductive roll that makes contact with a body to be charged in a state in which a voltage is applied to the roll and that charges the body to be charged, in which a surface of the roll satisfies the following conditions (a) and (b):

(a) the surface of the electro-conductive roll has a 10-point average roughness (Rz) of 5 μm or less; and (b) the surface of the electro-conductive roll has a dynamic ultra-microhardness in the range of 0.04 to 0.5.

The electro-conductive roll of the present invention is not particularly limited as long as it has electrically conductive properties as described above. Preferably, an electro-conductive roll having a conductive elastic layer and a conductive surface layer formed on a metal substrate is used. Examples of the electro-conductive roll include a charging roll, a transfer roll, a cleaning roll and the like.

Further, the above-described body to be charged is not limited to a photoreceptor, and any material that is charged (including polarity reversal) by making contact with the electro-conductive roll of the present invention, for example, recording paper, toner and the like, may be used.

First, a charging roll will be described as an example of the electro-conductive roll according to the present invention.

As described above, when a contact-type charging roll is used over a long period of time, foreign substances such as residual transfer toner, a carrier, paper dust and the like, which remain on the surface of a photoreceptor, adhere to the charging roll and contaminate the charging roll since the charging roll is in contact with the photoreceptor. The contaminated charging roll causes uneven charging of the photoreceptor, which contributes to deficiency in image quality, for example, unevenness of density, white spots, or color spots on the entire surface of an image, and the like. Further, foreign substances which come into a nip portion between the charging roll and the photoreceptor are pushed by the charging roll onto the photoreceptor, thereby causing the generation of streaks on the photoreceptor surface or the occurrence of a filming phenomenon due to foreign substances being embedded into the photoreceptor. Among the foreign substances which come into the nip portion between the charging roll and the photoreceptor, a large amount of foreign substance is found in the form of an aggregate ranging from several tens to several hundreds of μm in size, formed by residual transfer toner, carriers, paper dust and the like, having particle sizes of several μm.

Figure 1:
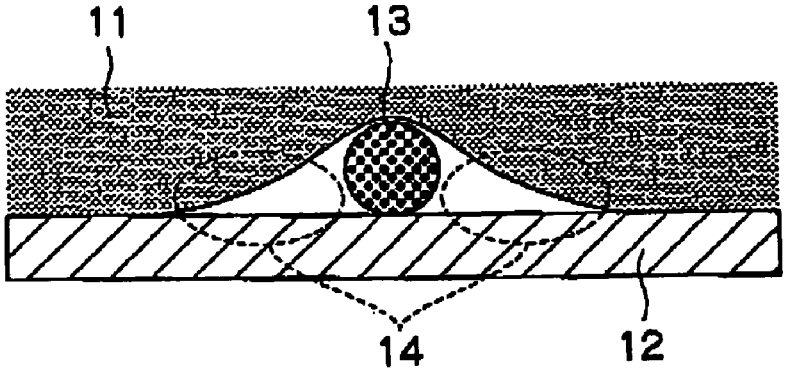
FIG. 1 is a schematic cross sectional view showing a state in which a charging roll with large foreign substances adhered thereto comes in contact with a photoreceptor.

FIG. 1 is a schematic cross sectional diagram that shows a state in which the charging roll with a large foreign substance adhered to the roll comes in contact with the photoreceptor. As shown in FIG. 1, when the above-described large foreign substance adheres to the surface of the charging roll 11, an insufficient contact portion between the charging roll 11 and the photoreceptor 12 is formed not only at a portion of the charging roll 11 to which the foreign substances 13 adhere, but also at the peripheral portion 14. Accordingly, a poor charging portion of the photoreceptor largely spreads out to the peripheral area of the foreign substance 13, thereby causing image defects such as a large white spot or a large color spot.

The number of the large foreign substances 13 is smaller than that of microscopic foreign substances. However, since high image quality has been demanded in recent years, poor charging caused by contact failure between the charging roll 11 and the photoreceptor 12, which results from the large foreign substance 13, becomes a significant problem.

The present inventors have diligently studied the above-described problem, and as a result, have found that the problem is solved when the surface of the charging roll 11 satisfies the condition (a) in which the surface of the electro-conductive roll has a 10-point average roughness (Rz) of 5 μm or less, and the condition (b) in which the surface of the electro-conductive roll has dynamic ultra-microhardness of 0.04 to 0.5. Preferably, the charging roll 11 also has, on an electro-conductive substrate, at least two electro-conductive layers comprised of a surface layer and an elastic layer, each of which is formed by coating a resin solution, and further, these layers satisfy the condition (c) in which (Rz) of the surface of elastic layer)×0.5≦film thickness of surface layer≦(Rz of the surface of elastic layer)×2, whereby image defects due to adhesion of foreign substances, and filming of the foreign substances onto the surface of the photoreceptor 12, can be prevented.

The principle which makes it possible to prevent adhesion of foreign substances by a charging roll of the present invention, generation of image defects due to a large foreign substance, and filming of foreign substance onto the surface of a photoreceptor can be presumed as described below.

It is believed that the charging roll and foreign substances adhere to each other electrostatically at an early stage. Therefore, the reduction of the electrostatic adhesion prevents generation of image defects due to the foreign substances, and occurrence of filming of the foreign substances onto a photoreceptor. The amount of the foreign substances that adhere electrostatically increases with increase of the contact area of the charging roll and the foreign substances.

The inventors have also found that it is most effective to reduce the surface roughness of the charging roll and set the hardness in the vicinity of the roll surface at a proper value so as to reduce the electrostatic adhesion of the foreign substances on the charging roll.

In order to reduce the surface roughness of the charging roll and set the hardness in the vicinity of the roll surface at a proper value, the relationship between the thickness of the surface layer and Rz of the surface of the elastic layer is preferably determined such that: (Rz of elastic-layer surface)×0.5≦thickness of surface layer≦(Rz of elastic-layer surface)×2, more preferably determined such that: (Rz of elastic-layer surface)×0.6≦layer thickness of surface layer≦(Rz of elastic-layer surface)×1.4, and most preferably determined such that: (Rz of elastic-layer surface)×0.8≦thickness of surface layer≦(Rz of elastic-layer surface)×1.2.

Further, the inventors have also found that the surface of the charging roll 11 satisfies the above-described conditions (a) and (b), and the charging roll 11 has at least two electro-conductive layers comprised of a surface layer and an elastic layer and further satisfies the following conditions (d) and (e);

(d) the surface of the elastic layer has Rz of 5 μm or less; and (e) the surface layer has a film thickness in the range of 3 μm to 15 μm, thereby resulting in desirable effects for preventing image defects caused by adhesion of foreign substances, and occurrence of filming of the foreign substances onto the surface of the photoreceptor 12.

Preferably, the surface of the elastic layer has Rz of 5 μm or less, and the surface layer has a layer thickness of 3 μm to 15 μm. More preferably, the surface of the elastic layer has Rz of 4 μm or less, and the surface layer has a layer thickness of 5 μm to 10 μm. Most preferably, the surface of the elastic layer has Rz of 3 μm or less, and the surface layer has a layer thickness of 5 μm to 10 μm. Rz of the surface of the elastic layer and the thickness of the surface layer are respectively in the above-described ranges, so that it is possible to lessen the surface roughness of the charging roll and set the hardness in the vicinity of the roll surface at a proper value.

The 10-point average roughness of the surface of the charging roll 11 according to the present invention is preferably 5 μm or less, more preferably 3 μm or less, and most preferably 2 μm or less. If the above-described Rz is more than 5 μm, the contact area between the foreign substance and the roll surface becomes larger. Therefore, the adhesive force between the foreign substance and the roll surface increases, and the foreign substance is apt to be embedded into a depression on the roll surface, so that adhesion of the foreign substance cannot be reduced.

Measurement of Rz is carried out by a surface roughness tester (SURFCOM 1400A, manufactured by Tokyo Seimitsu Co., Ltd.) according to JISB0601-1994 under the conditions: the measurement length is 4.0 mm, a cut-off value is 0.8, and the measurement speed is 0.30 mm/second in the axial direction of the roll.

The above-described dynamic ultra-microhardness (which may be hereinafter referred simply to as "DH") is a hardness which is calculated from the following expression (1) based on test load P(mN) and push-in depth DP (μm) when an indenter is pressed into a sample at a fixed indentation speed (mN/s).

$$DH=\alpha\times P/DP^2 \quad (1)$$

wherein, α represents a constant based on the shape of an indenter.

The above-described dynamic ultra-microhardness is measured by a Type DUH-W201S dynamic ultra-microhardness tester (manufactured by Shimadzu Corp.). The dynamic ultra-microhardness is obtained by measuring the indentation depth DP when a triangular pyramid-shaped indenter (ridge angle: 115 degree, α: 3.8584) is pressed into the charging roll at an indentation speed of 0.14 mN/s and at a test load of 1.0 mN according to the measurement of a soft material.

Figure 2:
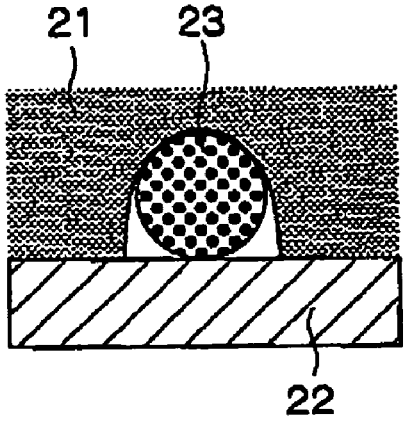
FIG. 2 is a schematic cross sectional view showing a state in which a charging roll of the present invention, with a large foreign substance adhered to the roll, comes in contact with a photoreceptor.
Figure 3:
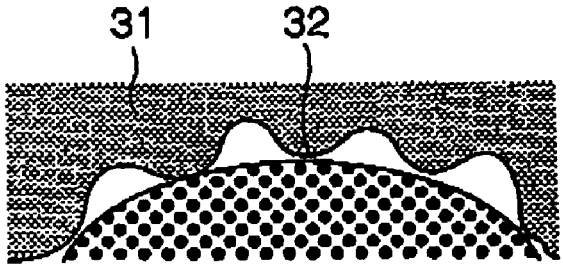
FIG. 3 is an enlarged cross sectional view of FIG. 2.

FIG. 2 shows a cross sectional diagram that schematically shows a state in which the charging roll of the present invention with a large foreign substance adhering to the roll comes in contact with a photoreceptor, in a manner similar to FIG. 1. FIG. 3 shows an enlarged cross sectional view of the contact portion between the charging roll and the large foreign substance when bringing into contact with each other.

As shown in FIG. 2, at a nip portion between a charging roll 21 of the present invention, and a photoreceptor 22, the charging roll 21 are in contact with the photoreceptor 22 in such a manner that the charging roll 21 wraps around a large foreign substance 23 as illustrated. As a result, the insufficient contact region 14 shown in FIG. 1 is reduced to a large extent and a charge failure region on the photoreceptor 22 can be minimized. Further, as shown in FIG. 3, a contact area of a charging roll 31 and a large foreign substance 32 is reduced. Accordingly, even if the large foreign substance 32 is in contact with the surface of the charging roll 31, the substance 32 does not closely adhere to the surface of the charging roll 31. As a result, the large foreign substance 32 is not apt to be continuously maintained on the surface of the charging roll 31.

The charging roll of the present invention, which satisfies the above-described principle, can be provided by controlling the dynamic ultra-microhardness thereof.

The above-described dynamic ultra-microhardness is a hardness in the process of pushing in an indenter, and includes properties of plastic deformation and elastic deformation of a sample. Further, the hardness of a microscopic portion in the area and depth can be measured by the dynamic ultra-microhardness, and the measured value thereof reflects material characteristics comprised of a multilayer structure. To that end, by controlling the dynamic ultra-microhardness, a charging roll can be provided which prevents adhesion of foreign substances, image defects caused by a large foreign substance, and occurrence of filming of foreign substance on the surface of a photoreceptor.

If the dynamic ultra-microhardness of the surface of the above-described charging roll 21 is low, the surface of the charging roll 21, when the charging roll 21 comes into contact with the photoreceptor 22, flexibly follows the foreign substance as shown in FIG. 2. Therefore, there is a low possibility that the foreign substance may adhere to the charging roll 21, which results from that the surface layer of the charging roll 21 is damaged and the foreign substance is embedded into the damaged portion of the roll surface, or that local nip failure may occur. Accordingly, in order to prevent foreign substances from adhering to the charging roll due to embedding of the foreign substances into the photoreceptor, and minimize image defects such as generation of a large white spot or a large color spot, which are caused by local charging failure when the large foreign substances 23 come into the nip portion between the charging roll 21 and the photoreceptor 22, it is required that the dynamic ultra-microhardness of the surface of the charging roll 21 is 0.5 or less in the present invention.

If the dynamic ultra-microhardness of the surface of the charging roll 21 is more than 0.5, the surface layer of the charging roll is damaged by the foreign substance, and adhesion of the foreign substance to the charging roll increases. Further, local insufficient nipping caused by adhesion of a large foreign substance occurs, and image defects such as generation of a white spot or a color spot tend to occur. Furthermore, filming of the foreign substance onto the surface of the photoreceptor may frequently occur.

On the other hand, if the dynamic ultra-microhardness of the surface of the charging roll 21 is high, the contact portion between the charging roll 21 and the foreign substance becomes smaller, as shown in FIG. 3. Therefore, the adhesion of the foreign substance to the surface of the charging roll 21 can be reduced. By increasing the dynamic ultra-microhardness of the surface of the charging roll 21, the surface profile of the charging roll 21 distorted by the foreign substance in a microscopic region can be quickly restored, and the foreign substance can be promptly released.

In the present invention, in order to prevent adhesion of the foreign substance to the surface of the charging roll 21, it is required that the dynamic ultra-microhardness of the surface of the charging roll 21 is 0.04 or more. If the dynamic ultra-microhardness of the surface of the electro-conductive roll 21 is less than 0.04, a contact area between the foreign substance and the charging roll becomes larger, or the deformation of the charging roll by the foreign substance is not sufficiently restored. Accordingly, the foreign substance cannot be efficiently released.

The dynamic ultra-microhardness of the surface of the charging roll 21 (electro-conductive roll) is measured by the above-described dynamic ultra-microhardness tester as the produced roll as such. The dynamic ultra-microhardness of the surface of the charging roll 21 is preferably 0.04 to 0.5, more preferably 0.04 to 0.2, and most preferably 0.05 to 0.15.

The charging roll of the present invention desirably has, on an electro-conductive substrate, at least two conductive layers comprised of a surface layer and an elastic layer formed by coating of a resin solution. In this case, the elastic layer may be constituted by a plurality of layers, or a primer layer may be provided between the electro-conductive substrate and the electro-conductive elastic layer so as to bond the electro-conductive substrate to the electro-conductive elastic layer.

Formation of the surface layer by a coating method is more suitable than formation of a surface layer using a resin tube in that a surface layer having a uniform layer thickness ranging from several μm to several tens of μm and a lower 10-point average roughness (Rz) can be easily formed.

The above-described electro-conductive substrate functions as an electrode and a supporting member of the charging roll, and comprises electro-conductive materials, for example, metal or metal alloy such as aluminum, copper alloy or stainless steel; iron plated with chromium or nickel; an electro-conductive resin, and the like.

The above-described electro-conductive elastic layer is formed by, for example, dispersing an electro-conductive agent in a rubber material. Examples of usable rubber materials include isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allylglycidyl ether copolymer rubber, ethylene-propylene-diene ternary copolymer rubber (EPDM), acrylonitrile-butadiene copolymer rubber, natural rubber, and blended rubber thereof. Among them, silicone rubber, ethylene-propylene rubber, epichlorohydrin-ethylene oxide copolymer rubber, epichlorohydrin-ethylene oxide-allylglycidyl ether copolymer rubber, acrylonitrile-butadiene copolymer rubber, and blended rubber thereof are preferably used. These rubber materials may be a foamed rubber or unfoamed rubber.

As the electro-conductive agent, an electronic electroconductive agent or ionic electro-conductive agent can be used. Examples of the electronic electro-conductive agent include fine powder of: carbon black such as Ketjen Black or acetylene black; pyrolytic carbon, graphite; various kinds of electro-conductive metal or metal alloy such as aluminum, copper, nickel or stainless steel; various kinds of electro-conductive metal oxide such as tin oxide, indium oxide, titanium oxide, tin oxide-antimony oxide solid solution, or tin oxide-indium oxide solid solution; insulating materials having a surface treated by an electroconductive process; and the like. Further, examples of ionic electro-conductive agents include: perchlorates or chlorates of tetraethylammonium, lauryl trimethyl ammonium and the like; perchlorates or chlorates of alkali metal such as lithium or magnesium, and alkali earth metal; and the like.

These electro-conductive agents may be used either singly or in the form of a combination of two or more types thereof. Further, the amount of addition thereof is not particularly limited. However, the amount of addition of the above-described electronic electroconductive agent is preferably 1 to 30 parts by mass with respect to 100 parts by mass of the rubber material, and more preferably 15 to 25 parts by mass. The amount of addition of the above-described ionic electroconductive agent is preferably 0.1 to 5.0 parts by mass with respect to 100 parts by mass of the rubber material, and more preferably 0.5 to 3.0 parts by mass.

A polymer material that forms the surface layer is not particularly limited as long as the surface of the charging roll 21 has the dynamic ultra-microhardness ranging from 0.04 to 0.5. Examples of the polymer materials include polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, ethylene-vinyl acetate copolymer, and the like.

Among these materials, polyamide, polyvinylidene fluoride, tetrafluoroethylene copolymer, polyester and polyimide are preferably used from the standpoint of releasing properties of from a toner. The above-described polymer materials may be used either singly or in the form of a combination of two or more types thereof. Further, the number average molecular weight of the high-polymer material is preferably in the range of 1,000 to 100,000, and more preferably in the range of 10,000 to 50,000.

The surface layer is formed as a composition obtained by mixing the electroconductive agent used in the electro-conductive elastic layer, and various types of fine particles, with the above-described polymer material. As the fine particles, metal oxides and composite metal oxides such as silicon dioxide, aluminum oxide or barium titanate, polymer fine particles such as tetrafluoroethylene or vinylidene fluoride are used either singly or in the form of a mixture thereof. However, the fine particles are not particularly limited to these particles.

The dynamic ultra-microhardness of the surface of the charging roll, mentioned previously, is also influenced by the properties of the above-described surface layer. Accordingly, in order that the surface of the charging roll has the dynamic ultra-microhardness ranging from 0.04 to 0.5, the amount of the electro-conductive agent and fine particles mixed as the compositions in the surface layer is preferably in the range of 5 to 120 parts by mass relative to 100 parts of the polymer material constituting the surface layer, and more preferably in the range of 8 to 50 parts by mass.

Thus, the charging roll was described as the electro-conductive roll of the present invention, but the electro-conductive roll of the present invention is also preferably used as a transfer roll in an image forming apparatus for electrophotography.

The transfer roll is used as a transfer member that transfers, to paper and the like, a toner image formed on the surface of a photoreceptor. The transfer roll, as is the case with the above-described charging roll, also comes into contact with a photoreceptor or paper, having residual toner adhered thereto, and therefore, foreign substances are apt to adhere to the transfer roll. Accordingly, by using the electro-conductive roll of the present invention as the transfer roll, transfer failure caused by adhesion of foreign substances onto the surface of the roll, or toner filming to a body to be charged can be prevented.

Further, the electro-conductive roll of the present invention is also preferably used as a cleaning roll in an image forming apparatus for electrophotography.

The cleaning roll is used as a cleaning member that cleans residual toner adhered to the surface of a photoreceptor after transferring an image, or residual toner adhered to the surface of an intermediate transfer body. If the toner is apt to adhere to the cleaning roll, removed toner is continuously accumulated on the surface of the cleaning roll, thereby resulting in failure of cleaning or toner filming to a body to be charged. Accordingly, the use of the electro-conductive roll of the present invention as the cleaning roll can address the above-described problem.

Additionally, the electro-conductive roll of the present invention is not limited to the above-described charging roll, transfer roll and cleaning roll, and can also be preferably employed for any application that is it necessary for the roll to prevent adhesion of foreign substances onto the roll surface with a voltage applied thereto.

Furthermore, in electrophotographic apparatuses using spherical and small-diameter toners which have been widely used recently, direct-current charging systems using a direct current voltage application method, and electrophotographic apparatuses using brushes or rolls as the cleaning member without using a blade, a great effect is obtained when the electro-conductive roll of the present invention is used as the charging roll.

Figure 4:
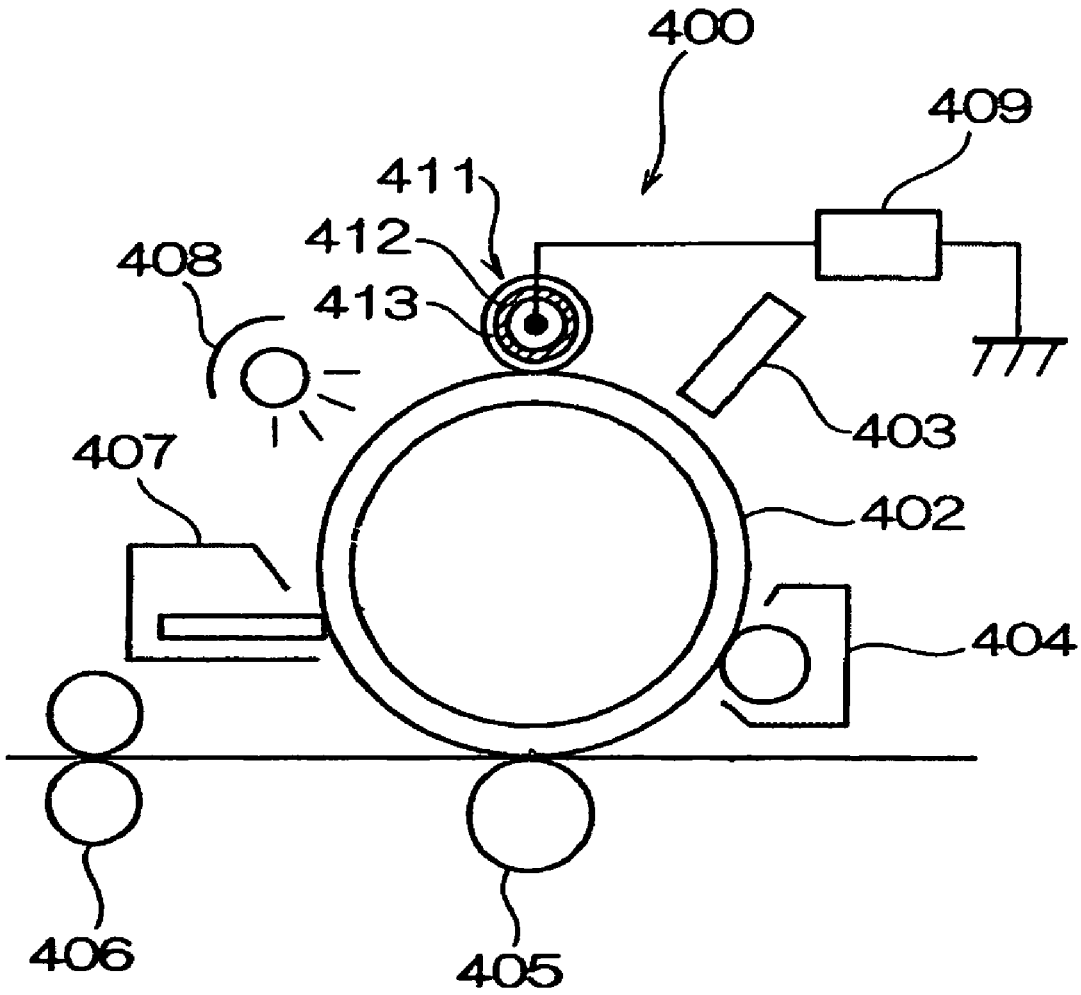
FIG. 4 is a schematic cross sectional view of an image forming apparatus using the charging roll of the present invention.

Next, FIG. 4 is a schematic cross sectional diagram illustrating the basic structure of a preferable embodiment of the image forming apparatus 400 of the present invention. The image forming apparatus shown in FIG. 4 is provided with an electrophotographic photoreceptor 402; a charging device (electro-conductive roll) 411 that charges the electrophotographic photoreceptor 402; a power supply 409 connected to the charging device 411; an exposure device 403 that exposes the electrophotographic photoreceptor 402, which is charged by the charging device 411; a developing device 404 that develops the portion exposed by the exposure device 403; a transfer device 405 that transfers the developed image, which was developed by the electrophotographic photoreceptor 402 by the developing device 404, to an image receiving body; a cleaning device 407; an eraser device 408; and a fusing device 406. In the apparatus illustrated in FIG. 4, the cleaning device 407 and eraser device 408 are included, however, it is possible for the apparatus to not be provided with these devices. Further, the charging device (electro-conductive roll) 411 may include, on an electro-conductive substrate, at least two electro-conductive layers comprised of an electro-conductive elastic layer 412 and an electro-conductive surface layer 413.

In FIG. 4, a contact charging device using the electro-conductive roll of the present invention is used as the charging device. In this charging device, DC voltage or voltage having volts AC voltage superimposed on DC voltage may be applied in order to charge the photoreceptor. By using the electrophotoreceptor of the present invention in an image forming apparatus employing a contact-type charging device in which voltage having AC voltage superimposed on DC voltage is applied, excellent abrasion-resistance can be achieved.

For the exposure device 403, any optical device that can imagewisely expose the electrophotographic photoreceptive surface with a light source such as a semiconductor laser, a light-emitting diode (LED), or a liquid crystal shutter may be used. For the developing device, any device using common developers such as 1 component or 2 component type regular or reversal developers may be used.

The following may also be used for the transfer device 405: any device using a contact-type transfer charger such as a belt, a roller, a film, and a rubber blade; and any Scorotron or Corotron transfer chargers using corona discharge. The conductive roll of the present invention may also be used for this contact-type transfer charger.

Although not illustrated in FIG. 4, an intermediate transfer body may be provided in the electrophotographic device of the present invention. Examples of intermediate transfer bodies that can be used in the present invention include conductive supports having an elastic layer comprising materials such as rubber, elastomer, or resin, and at least one coating layer laminated thereon. Usable materials for the coating layer include resins such as polyurethene resins, polyester resins, polystyrene resins, polyolefin resins, polybutadiene resins, polyamide resins, polyvinyl chloride resins, polyethylene resins, and fluorine resins containing carbon particles or metal powder dispersed therein. Further, the intermediate transfer body may be formed in different shapes, such as roller-shaped or belt-shaped.

EXAMPLES

The present invention will be specifically described with reference to the following examples, but the present invention is not limited to these examples.

Example 1

(Preparation of Electro-Conductive Roll 411-1)

Formation of Elastic Layer:

The following composition is mixed and kneaded by an open roll mill. The mixture prepared is applied, onto the surface of an electroconductive substrate having a diameter of 8 mm and formed by SUS416 stainless steel, in the shape of a cylinder having a thickness of 3 mm, and thereafter, is placed in a cylinderical-shaped mold having an inner diameter of 14.0 mm and vulcanized for 30 minutes at 170° C., and thereafter, is removed from the mold and ground. Thus, a cylindrical-shaped electro-conductive elastic layer 412A is obtained.

Composition

| | |
|---|---|
| Rubber material (epichlorohydrin-ethylene oxide-allylglycidyl ether copolymer rubber, Gechron 3106: manufactured by Nippon Zeon Co., Ltd.) | 100 parts by mass |
| Electro-conductive agent (carbon black, Trade name Asahi Thermal: manufactured by Asahi Carbon Co., Ltd.) | 25 parts by mass |
| Electroconductive agent (Trade name Ketjen Black EC: manufactured by Lion Corp.) | 8 parts by mass |
| Ionic electroconductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Nocceler DM: manufactured by Ouchi Shinko Kagaku Kogyo) | 2.0 parts by mass |
| Vulcanization accelerator (Nocceler TT: manufactured by Ouchi Shinko Kagaku Kogyo) | 0.5 parts by mass |

Formation of Surface Layer:

A dispersion liquid A obtained by dispersing the following composition by a beads mill is diluted with methanol and applied by dip-coating to a surface of the above-described electro-conductive elastic layer 412A, and thereafter, is heated and dried for 15 minutes at 140° C., thereby forming a surface layer 413A having a thickness of 4 μm. Thus, the electro-conductive roll 411-1 is obtained.

| | |
|---|---|
| Polymer material: (nylon copolymer) Trade name ALAMIN CM8000: manufactured by Toray K.K. | 100 parts by mass |
| Electro-conductive agent: (antimony-doped tin oxide) Trade name SN-100P: manufactured by Ishihara Sangyo Kaisha, Ltd. | 30 parts by mass |
| solvent (methanol) | 500 parts by mass |
| solvent (butanol) | 240 parts by mass |

(Evaluation of conductive roll 411-1)

Measurement of Dynamic Ultra-Microhardness:

The dynamic ultra-microhardness of the electro-conductive roll 411-1 is measured by the above-described method.

Measurement of 10-Point Average Roughness (Rz):

The 10-point average roughness (Rz) of the electro-conductive roll 411-1 is measured by the above-described method.

Measurement of Layer Thickness:

The film thickness of the electro-conductive roll 411-1 is measured from a microscopic image of a cross section of the electro-conductive roll.

Evaluation of Roll Mounted on Actual Machine:

The electro-conductive roll 411-1 is mounted, as a charging roll, on a color copying machine in which an image forming apparatus 400 as shown in FIG. 4 constitutes a unit and four units are arranged around an intermediate transfer belt, thus forming a tandem-type color copying machine (Trade name: DocuCentre Color 400CP: manufactured by Fuji Xerox Co., Ltd.), and a printing test is carried out for 50,000 sheets (A4-size) (25,000 sheets are printed under circumstances of 10° C. and 15% RH, and thereafter, 25,000 sheets are printed under circumstances of 28° C. and 85% RH). Incidentally, if a large problem arises during this test, printing is stopped at that time.

Evaluation of image quality is determined based on the following criteria according to the existence of color spots, white spots, and unevenness in density in a half-tone image.

A: no defect of color spots, white spots and unevenness in density

B: ten or less black and white spots are generated

C: ten or less black and white spots, and insignificant unevenness in density are generated D: black and white spots and minor unevenness in density are generated over an entire surface of the image E: black and white spots and unevenness in density are generated over an entire surface of the image Contamination of the roll is evaluated visually based on the following criteria for a roll after 50,000 sheets are printed.

A: almost no adhesion of foreign substances (adhesion of very little foreign substances)

B: local adhesion of foreign substances

C: adhesion of little foreign substances over an entire surface of the roll (slightly white)

D: adhesion of foreign substances over an entire surface of the roll

E: foreign substances are firmly fixed to over an entire surface of the roll (completely white)

The results are summarized in Tables 1-1 and 1-2.

Example 2

(Preparation of Electro-Conductive Roll 411-2)

Formation of Elastic Layer:

An electro-conductive elastic layer 412A is formed in the same way as in Example 1.

Formation of Surface Layer:

A dispersion liquid A prepared as in Example 1 is diluted with methanol and applied by dip-coating to the surface of the above-described conductive elastic layer 412A, and thereafter, is heated and dried for 15 minutes at 140° C., thereby forming a surface layer 413A having a thickness of 7 μm. Thus, an electro-conductive roll 411-2 is obtained.

(Evaluation of Electro-Conductive Roll 411-2)

Evaluation on Actual Machine:

The electro-conductive roll 411-2 is evaluated in the same manner as in Example 1. The results are summarized in Tables 1-1 and 1-2.

Example 3

(Preparation of Electro-Conductive Roll 411-3)

Formation of Elastic Layer:

An electro-conductive elastic layer 412A is formed in the same manner as in Example 1.

Formation of Surface Layer:

A dispersion liquid B obtained by dispersing the following composition by a beads mill is diluted with MEK, and applied by dip-coating to the surface of the above-described electro-conductive elastic layer 412A, and thereafter, is heated and dried for 30 minutes at 160° C., thereby forming a surface layer 413B having a thickness of 4 μm. Thus, an electro-conductive roll 411-3 is obtained.

| | |
|---|---|
| Polymer material (saturated copolymer polyester resin solution) Trade name Byron 30SS: manufactured by Toyo Spinning Co., Ltd. | 100 parts by mass |
| Hardening agent (amino resin solution) Trade name SUPER BECKAMINE G-821-60: manufactured by Dainippon Ink and Chemicals Inc.) | 26.3 parts by mass |
| Electro-conductive agent (carbon black) Trade name MONARCH 1000: manufactured by Cabot Specialty Chemicals Inc. | 14 parts by mass |

(Evaluation of electro-conductive roll 411-3)

Evaluation of Electro-Conductive Mounted on Actual Machine:

The electro-conductive roll 411-3 is evaluated in the same manner as in Example 1. The results are summarized in Tables 1-1 and 1-2.

Example 4

(Preparation of Electro-Conductive Roll 411-4)

Formation of Elastic Layer:

An electro-conductive elastic layer 412A is formed in the same manner as in Example 1.

Formation of Surface Layer:

A dispersion liquid B prepared as in Example 3 is diluted with MEK and applied by dip-coating to the surface of the electro-conductive elastic layer 412A, and thereafter, is heated and dried for 30 minutes at 160° C., thereby forming a surface layer 413B having a thickness of 7 μm. Thus, an electro-conductive roll 411-4 is obtained.

(Evaluation of Electro-Conductive Roll 411-4)

Evaluation of Electro-Conductive Roll Mounted on Actual Machine:

The electro-conductive roll 411-4 is evaluated in the same manner as in Example 1. The results are summarized in Tables 1-1 and 1-2.

Example 5

(Preparation of Electro-Conductive Roll 411-5)

Formation of Elastic Layer:

An electro-conductive elastic layer 412A is formed in the same manner as in Example 1.

Formation of Surface Layer:

A dispersion liquid B prepared as in Example 3 is diluted with MEK, and applied by dip-coating to the surface of the electro-conductive elastic layer 412A, and thereafter, is heated and dried for 30 minutes at 160° C., thereby forming a surface layer 413B having a thickness of 9 μm. Thus, an electro-conductive roll 411-5 is obtained.

(Evaluation of Electro-Conductive Roll 411-5)

Evaluation of Electro-Conductive Roll Mounted on Actual Machine:

The electro-conductive roll 411-5 is evaluated in the same manner as in Example 1. The results are summarized in Tables 1-1 and 1-2.

Example 6

(Preparation of Electro-Conductive Roll 411-6)

Formation of Elastic Layer:

The following compositions are kneaded by an open roll mill. The mixture prepared is applied, onto the surface of a conductive substrate having a diameter of 8 mm and formed from SUS416 stainless steel, in the shape of a cylinder having a thickness of 3 mm, and then, is placed in a cylindrical-shaped mold having an inner diameter of 14.0 mm and vulcanized for 30 minutes at 170° C., and thereafter, is removed from the mold, and ground. Thus, a cylindrical-shaped conductive elastic layer 412B is obtained.

| | |
|---|---|
| Rubber material (epichlorohydrin-ethylene oxide-allylglycidyl ether copolymer rubber, Trade name; Gechron 3106: manufactured by Nippon Zeon Co., Ltd.) | 100 parts by mass |
| Electro-conductive agent (carbon black, Trade name; Asahi Thermal: manufactured by Asahi Carbon Co., Ltd.) | 25 parts by mass |
| Electro-conductive agent (Trade name; Ketjen Black EC: manufactured by Lion Corp.) | 8 parts by mass |
| Ionic electro-conductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Nocceler DM: manufactured by Ouchi Shinko Kagaku Kogyo) | 2.0 parts by mass |
| Vulcanization accelerator (Nocceler TT: manufactured by Ouchi Shinko Kagaku Kogyo) | 0.5 parts by mass |

Formation of Surface Layer:

A dispersion liquid A prepared as in Example 1 is diluted with methanol, and applied by dip-coating to the surface of the conductive elastic layer 412B, and thereafter, is heated and dried for 15 minutes at 140° C., thereby forming a surface layer 413A having a thickness of 2 μm. Thus, an electro-conductive roll 411-6 is obtained.

(Evaluation of Electro-Conductive Roll 411-6)

Evaluation of Electro-Conductive Roll Mounted on Actual Machine:

The electro-conductive roll 411-6 is evaluated in the same manner as in Example 1. The results are summarized in Tables 1-1 and 1-2.

Example 7

(Preparation of Electro-Conductive Roll 411-7)

Formation of Elastic Layer:

The following composition is kneaded by an open roll mill. The mixture thus prepared is applied, to the surface of an electro-conductive substrate having a diameter of 8 mm and formed from SUS416 stainless steel, in the shape of a cylinder having a thickness of 1 mm.

| | |
|---|---|
| Rubber material (EPDM) EP65: manufactured by JSR | 100 parts by mass |
| Electro-conductive agent (carbon black, Trade name; Asahi Thermal: manufactured by Asahi Carbon Co., Ltd.) | 40 parts by mass |
| Electro-conductive agent (Trade name; Ketjen Black EC: manufactured by Lion Corp.) | 10 parts by mass |
| Foaming agent (Trade name; Vinyfor AC#3: manufactured by Eiwa Chemical Industry Co., Ltd.) | 8 parts by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shinko Kagaku Kogyo) | 0.5 parts by mass |

A mixture obtained by kneading the following composition by an open roll is applied to the surface formed as described above, in the shape of a cylinder having a thickness of 0.5 mm, and then, is placed in a cylindrical-shaped mold having an inner diameter of 14.0 mm and vulcanized and foamed for 30 minutes at 170° C., thereby obtaining a cylindrical-shaped electro-conductive elastic layer 412C with a non-foamed layer of rubber formed on the surface of an elastic layer of a foamed body (EPDM).

| | |
|---|---|
| Rubber material (epichlorohydrin-ethylene oxide-allylglycidyl ether copolymer rubber, Trade name; Gechron 3106: manufactured by Nippon Zeon Co., Ltd.) | 100 parts by mass |
| Electro-conductive agent (carbon black, Trade name; Asahi Thermal: manufactured by Asahi Carbon Co., Ltd.) | 20 parts by mass |
| Electro-conductive agent (Trade name; Ketjen Black EC: manufactured by Lion Corp.) | 8 parts by mass |
| Ionic electro-conductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shink Kagaku Kogyo) | 1.0 part by mass |

Formation of Surface Layer:

A dispersion liquid A prepared as in Example 1 is diluted with methanol and applied by dip-coating to the surface of the electro-conductive elastic layer 412C, and thereafter, is heated and dried for 15 minutes at 140° C., thereby forming a surface layer 413A having a thickness of 7 μm. Thus, an electro-conductive roll 411-7 is obtained.

(Evaluation of Electro-Conductive Roll 411-7)

Evaluation on Actual Machine:

The electro-conductive roll 411-7 is evaluated in the same manner as in Example 1. The results are summarized in Tables 1-1 and 1-2.

Example 8

(Preparation of Electro-Conductive Roll 411-8)

Formation of Elastic Layer:

The following composition is kneaded by an open roll mill. The mixture thus prepared is applied, onto the surface of an electro-conductive substrate having a diameter of 8 mm and formed from SUS416 stainless steel, in the shape of a cylinder having a thickness of 3 mm, and then, is placed in a cylindrical-shaped mold having an inner diameter of 14.0 mm and vulcanized for 30 minutes at 170° C., and thereafter, is removed from the mold, and ground. Thus, a cylindrical-shaped electro-conductive elastic layer 412D is obtained.

| | |
|---|---|
| Rubber material (epichlorohydrin-ethyleneoxide-allylglycidyl ether copolymer rubber, Trade name; Gechron 3106: manufactured by Nippon Zeon Co., Ltd.) | 100 parts by mass |
| Electro-conductive agent (carbon black, Trade name; Asahi Thermal: manufactured by Asahi Carbon Co., Ltd.) | 25 parts by mass |
| Electro-conductive agent (Trade name; Ketjen Black EC: manufactured by Lion Corp.) | 8 parts by mass |
| Ionic electro-conductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shinko Kagaku Kogyo) | 0.5 parts by mass |

Formation of Surface Layer:

A dispersion liquid A prepared as in Example 1 is diluted with methanol, and applied by dip-coating to the surface of the electro-conductive elastic layer 412D, and thereafter, is heated and dried for 15 minutes at 140° C., thereby forming a surface layer 413A having a thickness of 3 μm. Thus, an electro-conductive roll 411-8 is obtained.

(Evaluation of Electro-Conductive Roll 411-8)

Evaluation of Electro-Conductive Roll Mounted on Actual Machine:

The electro-conductive roll 411-8 is evaluated in the same manner as in Example 1. The results are summarized in Tables 1-1 and 1-2.

Comparative Example 1

(Preparation of Electro-Conductive Roll 411-10)

Formation of Elastic Layer:

An electro-conductive elastic layer 412A is formed in the same manner as in Example 1.

Formation of Surface Layer:

A dispersion liquid C obtained by dispersing the following composition by a beads mill is diluted with methanol, and applied by dip-coating to the surface of the electro-conductive elastic layer 412A, and thereafter, is heated and dried for 15 minutes at 140° C., thereby forming a surface layer 413C having a thickness of 4 μm. Thus, an electro-conductive roll 411-10 is obtained.

| | |
|---|---|
| Polymer material (copolymer nylon) Trade name; ALAMIN CM8000: manufactured by Toray K.K. | 100 parts by mass |
| Electro-conductive agent (antimony-doped tin oxide) SN-100P: manufactured by Ishihara Sangyo Kaisha, Ltd. | 30 parts by mass |
| Filler (tetrafluoroethylene) Trade name; TLP-10F-1: Mitsui DuPont Fluorochemicals KK | 40 parts by mass |
| Solvent (methanol) | 500 parts by mass |
| solvent (butanol) | 240 parts by mass |

(Evaluation of electro-conductive roll 411-10)

Evaluation of Electro-Conductive Roll Mounted on Actual Machine:

The electro-conductive roll 411-10 is evaluated in the same manner as in Example 1. The results are summarized in Table 2.

Comparative Example 2

(Preparation of Electro-Conductive Roll 411-11)

Formation of Elastic Layer:

An electro-conductive elastic layer 412A is formed in the same manner as in Example 1.

Formation of Surface Layer:

A dispersion liquid D obtained by dispersing the following composition by a beads mill is diluted with MEK and applied by dip-coating to the surface of the conductive elastic layer 412A, and thereafter, is heated and dried for 30 minutes at 160° C., thereby forming a surface layer 413D having a thickness of 4 μm. Thus, an electro-conductive roll 411-11 is obtained.

| | |
|---|---|
| Polymer material (saturated copolymer polyester resin solution) Trade name; Byron 30SS: Toyo Spinning Co., Ltd. | 100 parts by mass |
| Hardening agent (modified polyisocyanate solution) Trade name; CORONATE HL: manufactured by Nippon Polyurethane Kogyo Co. | 30 parts by mass |
| Electro-conductive agent (carbon black) Trade name; MONARCH 1000: manufactured by Cabot Specialty Chemicals Inc. | 15 parts by mass |

(Evaluation of electro-conductive roll 411-11)

Evaluation of Electro-Conductive Roll Mounted on Actual Machine:

The electro-conductive roll 411-11 is evaluated in the same manner as in Example 1. The results are summarized in Table 2.

Comparative Example 3

(Preparation of Electro-Conductive Roll 411-12)

Formation of Elastic Layer:

An electro-conductive elastic layer 412A is formed in the same manner as in Example 1.

Formation of Surface Layer:

A dispersion liquid A prepared as in Example 1 is diluted with MEK, and applied by dip-coating to the surface of the conductive elastic layer 412A, and thereafter, is heated and dried for 15 minutes at 140° C., thereby forming a surface layer 413A having a thickness of 8 μm. Thus, an electro-conductive roll 411-12 is obtained.

(Evaluation of Electro-Conductive Roll 411-12)

Evaluation of Electro-Conductive Roll Mounted on Actual Machine:

The electro-conductive roll 411-12 is evaluated in the same manner as in Example 1. The results are summarized in Table 2.

Example 9

(Preparation of Electro-Conductive Roll 411-9)

Formation of Elastic Layer:

An electro-conductive elastic layer 412A is formed in the same manner as in Example 1.

Formation of Surface Layer:

A dispersion liquid A prepared as in Example 1 is diluted with methanol, and applied by dip-coating to the surface of the electro-conductive elastic layer 412A, and thereafter, is heated and dried for 15 minutes at 140° C., thereby forming a surface layer 413A having a thickness of 2 μm. Thus, an electro-conductive roll 411-9 is obtained.

(Evaluation of Electro-Conductive Roll 411-9)

Evaluation of Electro-Conductive Roll Mounted on Actual Machine:

The electro-conductive roll 411-9 is evaluated in the same manner as in Example 1. The results are summarized in Tables 1-1 and 1-2.

TABLE 1-1

| | | Example 1 | Example 2 | Example 3 | Example 4 | Example 5 |
|---|---|---|---|---|---|---|
| electro- conductive roll Rz (μm) | | 1.5 | 1.3 | 3.1 | 2.0 | 1.8 |
| dynamic ultra-microhardness | | 0.14 | 0.28 | 0.05 | 0.08 | 0.10 |
| elastic layer Rz (μm) | | 4.8 | 4.8 | 4.8 | 4.8 | 4.8 |
| thickness of surface layer (μm) | | 4 | 7 | 4 | 7 | 9 |
| evaluation of electro-conductive roll mounted on actual machine | image quality | A | B | B | A | A |
| | contamination of roll | A | C | B | B | B |

TABLE 1-2

| | | Example 6 | Example 7 | Example 8 | Example 9 |
|---|---|---|---|---|---|
| electro- conductive roll Rz (μm) | | 1.6 | 1.2 | 4.8 | 3.4 |
| dynamic ultra-microhardness | | 0.10 | 0.26 | 0.16 | 0.10 |
| elastic layer Rz (μm) | | 2.6 | 6.0 | 8.2 | 4.8 |
| thickness of surface layer (μm) | | 2 | 7 | 3 | 2 |
| evaluation of electro-conductive roll mounted on actual machine | image quality | A | A | C | D |
| | contamination of roll | A | B | C | C |

TABLE 2

| | | Comparative Example 1 | Comparative Example 2 | Comparative Example 3 |
|---|---|---|---|---|
| electro-conductive roll Rz (μm) | | 6.2 | 2.6 | 1.2 |
| dynamic ultra-hardness | | 0.12 | 0.03 | 0.54 |
| elastic layer Rz (μm) | | 4.8 | 4.8 | 4.8 |
| thickness of surface layer (μm) | | 4 | 4 | 8 |
| evaluation of electro-conductive roll mounted on actual machine | image quality | E (stopping after printing of 10,000 sheets) | E | E |
| | contamination of roll | E | D | D |

Example 10

(Preparation of Electro-Conductive Roll 411-13)

Formation of Elastic Layer:

The following composition is kneaded by an open roll mill. The mixture thus prepared is applied, onto the surface of an electro-conductive substrate having a diameter of 8 mm and formed from SUS416 stainless steel, in the shape of a cylinder having a thickness of 3 mm, and then, is placed in a cylindrical-shaped mold having an inner diameter of 16.0 mm and vulcanized for 30 minutes at 170° C., and thereafter, is removed from the mold, and ground. Thus, a cylindrical-shaped electro-conductive elastic layer 412E having a diameter of 14.0 mm is obtained.

| | |
|---|---|
| Rubber material (epichlorohydrin-ethylene oxide-allylglycidyl ether copolymer rubber, Trade name; Gechron 3106: manufactured by Nippon Zeon Co., Ltd.) | 100 parts by mass |
| Electroconductive agent (carbon black, Trade name; Asahi Thermal: manufactured by Asahi Carbon Co., Ltd.) | 15 parts by mass |
| Electro-conductive agent (Trade name; Ketjen Black EC: manufactured by Lion Corp.) | 5 parts by mass |
| Ionic electroconductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shinko Kagaku Kogyo) | 0.5 parts by mass |
| Vulcanization accelerator auxiliaries (zinc oxide, one type of zinc oxide: manufactured by Seidou Corp.) | 3 parts by mass |
| stearic acid | 1.5 parts by mass |

Formation of Surface Layer:

A dispersion liquid E obtained by dispersing the following composition by a beads mill is diluted with MEK, and applied by dip-coating to the surface of the electro-conductive elastic layer 412E and thereafter, is heated and dried for 30 minutes at 160° C., thereby forming a surface layer 413E having a thickness of 7 μm. Thus, an electro-conductive roll 411-13 is obtained.

| | |
|---|---|
| Polymer material (saturated copolymer polyester resin solution) Trade name; Byron 30SS manufactured by Toyo Spinning Co., Ltd. | 100 parts by mass |
| Hardening agent (amino resin solution) Trade name; SUPER BECKAMINE G-821-60: manufactured by Dainippon Ink and Chemicals Inc.) | 26.3 parts by mass |
| Electro-conductive agent (carbon black) Trade name; MONARCH 1000: manufactured by Cabot Specialty Chemicals Inc. | 14 parts by mass |

(Evaluation of electro-conductive roll 411-13)

Evaluation of Electro-Conductive Roll Mounted on Actual Machine:

The electro-conductive roll 411-13 is evaluated in the same manner as in Example 1. The results are summarized in Tables 3-1 and 3-2.

Example 11

(Preparation of Electro-Conductive Roll 411-14)

Formation of Elastic Layer:

An electro-conductive elastic layer 412E is formed in the same manner as in Example 10.

Formation of Surface Layer:

The dispersion liquid E prepared as in Example 10 is diluted with MEK and applied by dip-coating to the surface of the conductive elastic layer 412E, and thereafter, is heated and dried for 30 minutes at 160° C., thereby forming a surface layer 413E having a thickness of 3 μm. Thus, an electro-conductive roll 411-14 is obtained.

(Evaluation of Electro-Conductive Roll 411-14)

Evaluation of Electro-Conductive Roll Mounted on Actual Machine:

The electro-conductive roll 411-14 is evaluated in the same manner as in Example 11. The results are summarized in Tables 3-1 and 3-2.

Example 12

(Preparation of Electro-Conductive Roll 411-15)

Formation of Elastic Layer:

The electro-conductive elastic layer 412E was formed in the same manner as in Example 10.

Formation of Surface Layer:

A dispersion liquid E prepared in the same manner as in Example 10 is diluted with MEK, and applied by dip-coating to the surface of the electro-conductive elastic layer 412E, and thereafter, is heated and dried for 30 minutes at 160° C., thereby forming a surface layer 413E having a thickness of 15 μm. Thus, the electro-conductive roll 411-15 is obtained.

(Evaluation of Electro-Conductive Roll 411-15)

Evaluation of Electro-Conductive Roll Mounted on Actual Machine:

The electro-conductive roll 411-15 is evaluated in the same manner as in Example 1. The results are summarized in Tables 3-1 and 3-2.

Example 13

(Preparation of Electro-Conductive Roll 411-16)

Formation of Elastic Layer:

An electro-conductive elastic layer 412F is formed in the same manner as in Example 10 except that conditions for grinding is changed such that Rz of the elastic layer surface is set to be 4.8 μm.

Formation of Surface Layer:

A dispersion liquid E prepared as in Example 10 is diluted with MEK and applied by dip-coating to the surface of the electro-conductive elastic layer 412F, and thereafter, is heated and dried for 30 minutes at 160° C., thereby forming a surface layer 413E having a thickness of 3 μm. Thus, an electro-conductive roll 411-16 is obtained.

(Evaluation of Conductive Roll 411-16)

Evaluation of Electro-Conductive Roll Mounted on Actual Machine:

The electro-conductive roll 411-16 is evaluated in the same manner as in Example 1. The results are summarized in Tables 3-1 and 3-2.

Example 14

(Preparation of Electro-Conductive Roll 411-17)

Formation of Elastic Layer:

An electro-conductive elastic layer 412F is formed in the same manner as in Example 13.

Formation of Surface Layer:

A dispersion liquid E prepared as in Example 10 is diluted with MEK, and applied by dip-coating to the surface of the electro-conductive elastic layer 412F, and thereafter, is heated and dried for 30 minutes at 160° C., thereby forming a surface layer 413E having a thickness of 15 μm. Thus, an electro-conductive roll 411-17 is obtained.

(Evaluation of Electro-Conductive Roll 411-17)

Evaluation of Electro-Conductive Roll Mounted on Actual Machine:

The electro-conductive roll 411-17 is evaluated in the same manner as in Example 1. The results are summarized in Tables 3-1 and 3-2.

Example 15

(Preparation of Electro-Conductive Roll 411-18)

Formation of Elastic Layer:

An electro-conductive elastic layer 412E is formed in the same manner as in Example 10.

Formation of Surface Layer:

A dispersion liquid F obtained by dispersing the following composition by a beads mill is diluted with methanol, and applied by dip-coating to the surface of the conductive elastic layer 412E, and thereafter, is heated and dried for 15 minutes at 140° C., thereby forming a surface layer 413F having a thickness of 5 μm. Thus, an electro-conductive roll 411-18 is obtained.

| | |
|---|---|
| Polymer material (copolymer nylon, Trade name; ALAMIN CM8000: manufactured by Toray K.K.) | 100 parts by mass |

-continued

| | |
|---|---|
| Electro-conductive agent (antimony-doped tin oxide SN-100P: manufactured by Ishihara Sangyo Kaisha, Ltd.) | 30 parts by mass |
| Solvent (methanol) | 500 parts by mass |
| Solvent (butanol) | 240 parts by mass |

(Evaluation of electro-conductive roll 411-18)

Evaluation of Electro-Conductive Roll Mounted on Actual Machine:

The electro-conductive roll 411-18 is evaluated in the same manner as in Example 1. The results are summarized in Tables 3-1 and 3-2.

Example 16

(Preparation of Electro-Conductive Roll 411-19)

Formation of Elastic Layer:

An electro-conductive elastic layer 412F is formed in the same manner as in Example 13.

Formation of Surface Layer:

A dispersion liquid F prepared as in Example 15 is diluted with methanol and applied by dip-coating to the surface of the electro-conductive elastic layer 412F, and thereafter, is heated and dried for 15 minutes at 140° C., thereby forming a surface layer 413F having a thickness of 15 μm. Thus, an electro-conductive roll 411-19 is obtained.

(Evaluation of Electro-Conductive Roll 411-19)

Evaluation of Electro-Conductive Roll Mounted on Actual Machine:

The electro-conductive roll 411-19 is evaluated in the same manner as in Example 1. The results are summarized in Tables 3-1 and 3-2.

Example 17

(Preparation of Electro-Conductive Roll 411-20)

Formation of Elastic Layer:

The following composition is kneaded by an open roll mill. The mixture thus prepared is applied, onto the surface of an electro-conductive substrate having a diameter of 8 mm and formed from SUS416 stainless steel, in the shape of a cylinder having a thickness of 1 mm.

| | |
|---|---|
| Rubber material (EPDM EP65: manufactured by JSR) | 100 parts by mass |
| Electro-conductive agent (carbon black, Trade name; Asahi Thermal: manufactured by Asahi Carbon Co., Ltd.) | 40 parts by mass |
| Electro-conductive agent (Trade name; Ketjen Black EC: manufactured by Lion Corp.) | 10 parts by mass |
| Foaming agent (Vinyfor AC#3: manufactured by Eiwa Chemical Industry Co., Ltd.) | 8 parts by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shinko Kagaku Kogyo) | 0.5 parts by mass |

A mixture obtained by kneading the following composition by an open roll mill is applied to the surface formed as described above, in the shape of a cylinder having a thickness of 0.5 mm, and then, is placed in a cylindrical-shaped mold having an inner diameter of 14.0 mm, and is vulcanized and foamed for 30 minutes at 170° C., thereby obtaining a cylindrical-shaped electro-conductive elastic layer 412G with a non-foamed layer of rubber formed on the surface of an elastic layer of a foamed body (EPDM).

| | |
|---|---|
| Rubber material (epichlorohydrin-ethylene oxide-allylglycidyl ether copolymer rubber, Trade name; Gechron 3106: manufactured by Nippon Zeon Co., Ltd.) | 100 parts by mass |
| Electro-conductive agent (carbon black, Trade name; Asahi Thermal: manufactured by Asahi Carbon Co., Ltd.) | 15 parts by mass |
| Electro-conductive agent (Trade name; Ketjen Black EC: manufactured by Lion Corp.) | 5 parts by mass |
| Ionic electro-conductive agent (lithium perchlorate) | 1 part by mass |
| Vulcanizing agent (sulfur 200-mesh: manufactured by Tsurumi Kagaku Kogyo) | 1 part by mass |
| Vulcanization accelerator (Trade name; Nocceler DM: manufactured by Ouchi Shinko Kagaku Kogyo) | 2.0 parts by mass |
| Vulcanization accelerator (Trade name; Nocceler TT: manufactured by Ouchi Shinko Kagaku Kogyo) | 0.5 parts by mass |
| Vulcanization accelerator auxiliaries (zinc oxide one type: manufactured by Seidou Corp.) | 3 parts by mass |
| Stearic acid | 1.5 parts by mass |

Formation of Surface Layer:

A dispersion liquid E prepared as in Example 10 is diluted with MEK and applied by dip-coating to the surface of the electro-conductive elastic layer 412G, and thereafter, is heated and dried for 30 minutes at 160° C., thereby forming a surface layer 413E having a thickness of 7 μm. Thus, an electro-conductive roll 411-20 is obtained.

(Evaluation of Conductive Roll 411-20)

Evaluation of Electro-Conductive Roll Mounted on Actual Machine:

The electro-conductive roll 411-20 is evaluated in the same manner as in Example 1. The results are summarized in Tables 3-1 and 3-2.

TABLE 3-1

| | | Example 10 | Example 11 | Example 12 | Example 13 |
|---|---|---|---|---|---|
| electro-conductive roll Rz (μm) | | 0.8 | 2.4 | 1.0 | 5.0 |
| dynamic ultra-microhardness | | 0.08 | 0.04 | 0.15 | 0.04 |
| elastic layer Rz (μm) | | 2.5 | 2.5 | 2.5 | 4.8 |
| thickness of surface layer (μm) | | 7 | 3 | 15 | 3 |
| evaluation of electro-conductive roll mounted on actual machine | image quality | A | A | A | B |
| | contamination of roll | A | A | A | C |

TABLE 3-2

| | | Example 14 | Example 15 | Example 16 | Example 17 |
|---|---|---|---|---|---|
| electro-conductive roll Rz (μm) | | 3.2 | 2.1 | 1.2 | 1.1 |
| dynamic ultra-microhardness | | 0.15 | 0.10 | 0.48 | 0.08 |
| elastic layer Rz (μm) | | 4.8 | 2.5 | 4.8 | 3.0 |
| thickness of surface layer (μm) | | 15 | 5 | 15 | 7 |
| evaluation of electro-conductive roll mounted on actual machine | image quality | A | A | B | A |
| | contamination of roll | B | B | C | A |

Comparative Example 4

(Preparation of Electro-Conductive Roll 411-21)

Formation of Elastic Layer:

An electro-conductive elastic layer 412F is formed in the same manner as in Example 13.

Formation of Surface Layer:

A dispersion liquid G obtained by dispersing the following composition by a beads mill is diluted with MEK, and applied by dip-coating to the surface of the conductive elastic layer 412F, and thereafter, is heated and dried for 30 minutes at 160° C., thereby forming a surface layer 413G having a thickness of 7 μm. Thus, an electro-conductive roll 411-21 is obtained.

| | |
|---|---|
| Polymer material (saturated copolymer polyester resin solution; Trade name; Byron 30SS: manufactured by Toyo Spinning Co., Ltd.) | 100 parts by mass |
| Hardening agent (amino resin solution) Trade name; SUPER BECKAMINE G-821-60: manufactured by Dainippon Ink and Chemicals Inc.) | 26.3 parts by mass |
| Electro-conductive agent (carbon black; Trade name; MONARCH1000: manufactured by Cabot Specialty Chemicals Inc.) | 14 parts by mass |
| Tetrafluoroethylene (Trade name; TLP-10F-1: manufactured by Mitsui DuPont Fluorochemicals KK) | 30 parts by mass |

(Evaluation of electro-conductive roll 411-21)

Evaluation of Electro-Conductive Roll Mounted on Actual Machine:

The electro-conductive roll 411-21 is evaluated in the same manner as in Example 1. The results are summarized in Table 4.

Comparative Example 5

(Preparation of Electro-Conductive Roll 411-22)

Formation of Elastic Layer:

An electro-conductive elastic layer 412H is formed in the same manner as in Example 10 except that conditions for grinding is changed such that Rz of the elastic layer surface is set to be 5.2 μm.

Formation of Surface Layer:

A dispersion liquid E prepared as in Example 10 is diluted with MEK, and applied by dip-coating to the surface of the electro-conductive elastic layer 412H, and thereafter, is heated and dried for 30 minutes at 160° C., thereby forming a surface layer 413E having a thickness of 3 μm. Thus, an electro-conductive roll 411-22 is obtained.

(Evaluation of Electro-Conductive Roll 411-22)

Evaluation of Electro-Conductive Roll Mounted on Actual Machine:

The electro-conductive roll 411-22 is evaluated in the same manner as in Example 1. The results are summarized in Table 4.

Comparative Example 6

(Preparation of Electro-Conductive Roll 411-23)

Formation of Elastic Layer:

An electro-conductive elastic layer E is formed in the same manner as in Example 10.

Formation of Surface Layer:

The dispersion liquid E prepared as in Example 10 is diluted with MEK and applied by dip-coating to the surface of the electro-conductive elastic layer 412E, and thereafter, is heated and dried for 30 minutes at 160° C., thereby forming a surface layer 413E having a thickness of 20 μm, and, an electro-conductive roll 411-23 is obtained.

(Evaluation of Electro-Conductive Roll 411-23)

Evaluation of Electro-Conductive Roll Mounted on Actual Machine:

The electro-conductive roll 411-23 is evaluated in the same manner as in Example 1. The results are summarized in Table 4.

Comparative Example 7

(Preparation of Electro-Conductive Roll 411-24)

Formation of Elastic Layer:

A dispersion liquid E prepared as in Example 10 is diluted with MEK, and applied by dip-coating to the surface of the electro-conductive elastic layer 412H, and thereafter, is heated and dried for 30 minutes at 160° C., thereby forming a surface layer 413E having a thickness of 16 μm. Thus, an electro-conductive roll 411-24 is obtained.

(Evaluation of Electro-Conductive Roll 411-24)

Evaluation of Electro-Conductive Roll Mounted on Actual Machine:

The electro-conductive roll 411-24 is evaluated in the same manner as in Example 1. The results are summarized in Table 4.

TABLE 4

| | Comparative Example 4 | Comparative Example 5 | Comparative Example 6 | Comparative Example 7 |
|---|---|---|---|---|
| conductive roll Rz (μm) | 6.2 | 5.5 | 1.2 | 5.1 |
| dynamic ultra-microhardness | 0.08 | 0.04 | 1.8 | 0.16 |

TABLE 4-continued

| | | Comparative Example 4 | Comparative Example 5 | Comparative Example 6 | Comparative Example 7 |
|---|---|---|---|---|---|
| elastic layer Rz (μm) | | 4.8 | 5.2 | 2.5 | 5.2 |
| thickness of surface layer (μm) | | 7 | 3 | 20 | 16 |
| evaluation of electro-conductive roll mounted on actual machine | image quality | E stopping after printing of 10,000 sheets | E | D | E |
| | contamination of roll | E | E | D | E |

According to the present invention, it becomes possible to provide an electro-conductive roll which can efficiently prevent adhesion of foreign substances onto a surface of the electro-conductive roll, for example, a charging roll which prevents generation of image defects resulting from: contamination of a charging roll caused by foreign substances coming into a nip portion between the charging roll and a photoreceptor; local nip failure; and filming to the photoreceptor.

What is claimed is:

1. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c):

(c) (Rz of a surface of the electro-conductive elastic layer)×0.5≦thickness of the electro-conductive surface layer≦(Rz of a surface of the elastic layer)×2.

2. An electro-conductive roll according to claim 1, wherein the electro-conductive elastic layer is formed by dispersing an electro-conductive agent in at least one type of rubber material selected from the group consisting of isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allylglycidyl ether copolymer rubber, ethylene-propylene-diene ternary copolymer rubber (EPDM), acrylonitrile-butadiene copolymer rubber, natural rubber, and blended rubbers thereof.

3. An electro-conductive roll according to claim 2, wherein said electro-conductive agent is at least one type of electro-conductive material selected from the group consisting of fine grains of an electronic conductive agent, and an ionic conductive agent.

4. An electro-conductive roll according to claim 3, wherein the electro-conductive elastic layer is an elastic layer that includes the electronic conductive agent in the range of 1 to 30 parts by mass with respect to 100 parts by mass of the rubber material, or an electro-conductive elastic layer that includes the ionic conductive agent in the range of 0.1 to 5.0 parts by mass with respect to 100 parts by mass of the rubber material.

5. An electro-conductive roll according to claim 1, wherein the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer.

6. An electro-conductive roll according to claim 5, wherein the surface layer includes at least one type of electrically conductive material selected from the group consisting of fine grains of an electronic conductive agent, and an ionic conductive agent.

7. An electro-conductive roll according to claim 6, wherein the surface layer is formed by application of a resin solution.

8. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less;

(b) the surface of the electro-conductive roll has a dynamic ultra-microhardness in the range of 0.04 to 0.5;

and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c):

(c) (Rz of a surface of the electro-conductive elastic layer)×0.5≦thickness of the electro-conductive surface layer≦(Rz of a surface of the elastic layer)×2;

the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent;

wherein the electro-conductive roll is a charging roll.

9. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll is a transfer roll.

10. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less;

(b) the surface of the electro-conductive roll has a dynamic ultra-microhardness in the range of 0.04 to 0.5;

and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c):

(c) (Rz of a surface of the electro-conductive elastic layer)×0.5≦thickness of the electro-conductive surface layer≦(Rz of a surface of the elastic layer)×2;

the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent;

wherein the electro-conductive roll is a transfer roll.

11. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll is a cleaning roll.

12. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less;

(b) the surface of the electro-conductive roll has a dynamic ultra-microhardness in the range of 0.04 to 0.5;

and wherein the electro-conductive roll includes, on an electro-conductive substrate, at least two electro-conductive layers comprised of at least an electro-conductive elastic layer and an electro-conductive surface layer, and the electro-conductive elastic layer is formed by dispersing an electro-conductive agent in a rubber material; and the electro-conductive elastic layer and the electro-conductive surface layer satisfy the following relationship (c):

(c) (Rz of a surface of the electro-conductive elastic layer)×0.5≦thickness of the electro-conductive surface layer≦(Rz of a surface of the elastic layer)×2;

the surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer; and the surface layer includes at least one type of electrically conductive material selected from the group consisting of fine grains of an electronic conductive agent, and an ionic conductive agent;

wherein the electro-conductive roll is a cleaning roll.

13. An electro-conductive roll that makes contact with a body to be charged in a state in which a voltage is applied to the roll, and charges the body to be charged, wherein a surface of the electro-conductive roll satisfies the following conditions (a) and (b):

(a) the surface of the electro-conductive roll has a 10-point average roughness of 5 μm or less; and (b) the surface of the electro-conductive roll has a dynamic ultra-microhardness in the range of 0.04 to 0.5; and wherein the electro-conductive roll includes, on an electro-conductive substrate, two or more electro-conductive layers comprised of at least an electro-conductive elastic layer and an electro-conductive surface layer, and the electro-conductive elastic layer and the electro-conductive surface layer satisfy the following conditions (d) and (e):

(d) a surface of the electro-conductive elastic layer has an Rz of 5 μm or less; and (e) the electro-conductive surface layer has a film thickness of 3 μm to 15 μm.

14. An electro-conductive roll according to claim 13, wherein the electro-conductive elastic layer is formed by dispersing an electrically conductive agent in at least one type of rubber material selected from the group consisting of isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allylglycidyl ether copolymer rubber, ethylene-propylene-diene ternary copolymer rubber (EPDM), acrylonitrile-butadiene copolymer rubber, natural rubber, and blended rubbers thereof.

15. An electro-conductive roll according to claim 14, wherein the electro-conductive agent is at least one type of electro-conductive material selected from the group consisting of fine grains of an electronic conductive agent, and an ionic conductive agent.

16. An electro-conductive roll according to claim 13, wherein the electro-conductive surface layer includes at least one type of polymer material selected from the group consisting of polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluoro rubber, epoxy resin, polycarbonate, polyvinyl alcohol, cellulose, polyvinylidene chloride, polyvinyl chloride, polyethylene, and ethylene-vinyl acetate copolymer.

17. An electro-conductive roll according to claim 16, wherein the electro-conductive surface layer is formed by application of a resin solution.

18. An image forming apparatus comprising:

a photoreceptor;

a charging device that charges the photoreceptor;

an exposure device that exposes the charged photoreceptor and forms an electrostatic latent image;

a developing device that develops the electrostatic latent image with a toner; and a transfer device that transfers a toner image to a receiving medium;

wherein the charging device, in a state where voltage is applied thereto, comes into contact with the photoreceptor, and comprises an electro-conductive roll that charges the photoreceptor, wherein a surface of the electro-conductive roll satisfies the following conditions (a) and (b):

(a) the surface of the electro-conductive roll has a 10-point average roughness (Rz) of 5 μm or less; and (b) the surface of the electro-conductive roll has a dynamic ultra-microhardness in the range of 0.04 to 0.5;

and wherein the electro-conductive roll includes, on an electro-conductive substrate, two or more electro-conductive layers comprised of at least an electro-conductive elastic layer and an electro-conductive surface layer, and the electro-conductive elastic layer and the electro-conductive surface layer satisfy the following conditions (d) and (e):

(d) a surface of the electro-conductive elastic layer has an Rz of 5 μm or less; and (e) the electro-conductive surface layer has a film thickness of 3 μm to 15 μm.

* * * * *